US012799568B2

(12) United States Patent
Tan et al.

(10) Patent No.: US 12,799,568 B2
(45) Date of Patent: Nov. 17, 2026

(54) HIGH STRENGTH CAST MAGNESIUM ALLOY AND PREPARATION METHOD THEREOF

(71) Applicant: Chongqing University, Chongqing City (CN)

(72) Inventors: Jun Tan, Chongqing City (CN); Guangming He, Chongqing City (CN); Chunhua Ran, Chongqing City (CN); Jijiang Liu, Chongqing City (CN); Boyan Huang, Chongqing City (CN); Yu Qi, Chongqing City (CN); Gang Ma, Chongqing City (CN); Zujiang Tang, Chongqing City (CN); Jianbo Li, Chongqing City (CN); Xianhua Chen, Chongqing City (CN); Bin Jiang, Chongqing City (CN); Fusheng Pan, Chongqing City (CN)

(73) Assignee: Chongqing University, Chongqing City (CN)

( * ) Notice: Subject to any disclaimer, the term of this patent is extended or adjusted under 35 U.S.C. 154(b) by 598 days.

(21) Appl. No.: 18/326,421

(22) Filed: May 31, 2023

(65) Prior Publication Data

US 2023/0383386 A1 Nov. 30, 2023

(30) Foreign Application Priority Data

May 31, 2022 (CN) ..... 202210604213.X

(51) Int. Cl.
*C22C 23/04* (2006.01)
*B22D 21/00* (2006.01)
(Continued)

(52) U.S. Cl.
CPC ..... *C22C 23/04* (2013.01); *B22D 21/007* (2013.01); *C22B 9/10* (2013.01); *C22C 1/03* (2013.01); *C22F 1/002* (2013.01); *C22F 1/06* (2013.01)

(58) Field of Classification Search
CPC .. C22C 23/04; C22C 1/03; C22C 1/02; C22C 23/02; B22D 21/007; C22B 9/10; C22F 1/002; C22F 1/06; Y02P 10/20
See application file for complete search history.

(56) References Cited

FOREIGN PATENT DOCUMENTS

CN 1699612 A 11/2005
CN 1938441 A 3/2007
(Continued)

OTHER PUBLICATIONS

CN-110863130-A, machine translation. (Year: 2020).*
CN-112680645-A, machine translation. (Year: 2021).*

*Primary Examiner* — John A Hevey

(57) ABSTRACT

A high strength cast magnesium alloy, relating to the technical field of magnesium alloy material preparation. The composition and mass percentage of cast magnesium alloy are: Zn 7.0%, Al 3.0%~5.0%, Mn 0.3%~0.5%, RE 0.5%~1%, the total amount of unavoidable impurities is less than or equal to 0.04%, and the allowance is Mg, wherein the RE includes La and Ce, La and Ce account for 35% and 65% of the total amount of RE, respectively. Among them, Mn, La and Ce are added in the form of Mg-5 wt. % Mn, Mg-30 wt. % La and Mg-30 wt. % Ce intermediate alloys respectively. Then it is prepared through battering, melting, melt purification, pouring and heat treatment. By adding RE, the alloy melt can be purified, and the corrosion resistance and casting performance of the alloy can be increased. The tensile strength of the alloy is 300 MPa~314 MPa, the elongation is 7%-13%, and the light rare earth content is low,
(Continued)

the raw material and processing cost is low, and it is easy to realize mass production.

9 Claims, 6 Drawing Sheets

(51) Int. Cl.

| | |
|---|---|
| ***C22B 9/10*** | (2006.01) |
| ***C22C 1/03*** | (2006.01) |
| ***C22F 1/00*** | (2006.01) |
| ***C22F 1/06*** | (2006.01) |

(56) References Cited

FOREIGN PATENT DOCUMENTS

| | | | | | |
|---|---|---|---|---|---|
| CN | 103952613 | A | | 7/2014 | |
| CN | 110863130 | A | * | 3/2020 | ..... C21D 9/70 |
| CN | 112680645 | A | * | 4/2021 | |
| KR | 101594857 | B1 | | 2/2016 | |
| WO | 2020203980 | A1 | | 10/2020 | |

* cited by examiner

HIGH STRENGTH CAST MAGNESIUM ALLOY AND PREPARATION METHOD THEREOF

TECHNICAL FIELD

The present invention relates to the technical field of magnesium alloy material preparation, specifically to a high strength cast magnesium alloy and preparation method thereof.

BACKGROUND TECHNOLOGY

As the lightest metal structural material in practical application, magnesium alloy plays a significant role in lightweight, energy consumption reduction, environmental pollution reduction and other aspects, and is known as one of the "green environmental protection engineering materials in the 21st century". It is used in automobile, national defense, aerospace, electronics, machinery and other industrial fields, and has a promising development prospect. However, the application of magnesium alloy is far less widespread than that of ferrous materials and aluminum alloy. This is mainly because magnesium alloy itself has such key problems as low absolute strength, insufficient toughness, low creep resistance at high temperature and poor corrosion resistance, which further limits the development and application of magnesium alloy.

Mg—Zn—Al series alloys with high zinc content is a kind of cheap and heat-resistant magnesium alloys, which have great commercial application prospect. Mg—Zn—Al series alloys are considered to be one of the most promising heat-treatable strengthening alloys due to its high aging hardening efficiency. The strengthening methods mainly include solid solution strengthening, precipitation strengthening, dispersion strengthening and fine-crystal strengthening, etc., and other alloying elements can also be added to enhance the properties of magnesium alloys. Therefore, it is expected to develop high strength cast magnesium alloy products and expand the application range of magnesium alloy.

Adding rare earth elements as an effective means to improve the strength of magnesium alloys has been adopted by many researchers. Rare earth elements can improve the casting properties of magnesium alloys, form high melting point intermetallic compounds and refine the grain size of alloys. In addition, some rare earth elements have the effect of solid solution and precipitation strengthening on magnesium alloys, which can greatly improve the mechanical properties of alloys. At present, most of the high strength cast magnesium alloys developed have added heavy rare earth elements with high content and high price. The Chinese invention patent with the authorisation number CN105483485B discloses a high strength cast magnesium alloy containing Zn and heavy rare earth Gd. After the heat treatment process of solid solution and ageing, a high strength cast magnesium alloy product with the tensile strength of 400 to 430 MPa and yield strength of 290 to 330 MPa is finally obtained. However, its Gd content is 1018 wt. % and the cost of production is too high. The Chinese Invention patent with the publication number CN102534330B discloses a preparation method of high strength cast magnesium alloy. The prepared Mg—Gd—Y—Al alloy containing rare earth contains 8~14 wt. % of Gd and 1~5 wt. % of Y. After solution and aging treatment, the range of tensile strength and elongation at room temperature increased to 260~360 MPa and 1.5~8% respectively. The Chinese Invention patent with the publication number CN100335666C also discloses a high strength cast magnesium alloy containing rare earth and its preparation method. The Nd content added to the alloy is 2.5~3.6 wt. %. The high strength Mg—Nd—Zr—Zn—Ca magnesium alloys have been prepared by heat treatment processes of solution and aging. The range of tensile strength and elongation at room temperature are 260~320 MPa and 5~15%, respectively, depending on the composition and process. Through By comparison, it can be found that the said high strength cast magnesium alloys all have a remarkable feature, that they all add high content of heavy rare earth elements.

Although the mechanical properties of the alloy can be improved by adding high content of heavy rare earth elements, the preparation process of the alloy is complicated, the production cost is high, the substitutability is poor and it is not suitable for large-scale industrial production and application. The technology of preparing high performance magnesium alloys by adding trace amounts of inexpensive light rare earth elements is not common in the prior art.

Content of Invention

Aiming at the deficiency of the prior art, the invention provides a high strength cast magnesium alloy and preparation method thereof, which solves the problem that the high performance magnesium alloy can not be prepared by adding trace light rare earth elements with low price in the prior art.

A high strength cast magnesium alloy, the composition and mass percentage of the cast magnesium alloy are: Zn 7.0%, Al 3.0%~5.0%, Mn 0.3%~0.5%, RE 0.5%~1%, The total amount of inevitable impurities is less than or equal to 0.04%, and the balance is Mg, wherein the RE include La and Ce, which accounted for 35% and 65% of the total added RE, respectively, among them, Mn, La and Ce are added in the form of Mg-5 wt. % Mn, Mg-30 wt. % La and Mg-30 wt. % Ce intermediate alloys respectively.

The invention also provides The method for preparing a high strength cast magnesium alloy, comprising the steps of:

① Batching: Zn, Al, Mg-5 wt. % Mn, Mg-30 wt. % La, Mg-30 wt. % Ce and Mg are batched according to mass percentages and then dried;

② Smelting: firstly putting the Al, Mg-5 wt. % Mn and pure Mg into a iron crucible, then melted using a resistance furnace, the melting temperature is controlled between 740° C. and 760° C. and a gas mixture is used as a protective gas during melting, after all the metal in the crucible has been melted, Zn, Mg-30 wt. % La and Mg-30 wt. % Ce are finally added thereto, the initial alloy melt is obtained after 1520 mins of smelting;

③ Melt purification: RJ-6 refining agent is used to refine the alloy melt obtained in step ②, in which the amount of RJ-6 refining agent is 1-2% of the weight of the total furnace charge, during the refining process, it needs to be stirred for 3~5 min, after refining, the alloy melt is stirred and slagged, and then the temperature is adjusted to 720740° C. and the heat is kept for 2030 min;

④ Casting: the alloy melt obtained in step ③ is poured into the mould and is demoulded after 5 to 10 mins of pouring, and is cooled to room temperature in air to obtain the alloy ingots;

⑤ Heat treatment: the alloy ingots obtained in step ④ are subjected to primary solid solution treatment at 350° C. for 40 h; secondary solid solution treatment at 370° C. for 8 h and finally quenched in water at a temperature of 10~20° C.; after the solid solution treatment, the high strength cast magnesium alloy is obtained by preaging at for 24 h, then at 175° C. for 2 h, and finally quenching in water at a temperature of 10~20° C.

Preferably, Zn, Al, Mg-5 wt. % Mn, mg-30 wt. % La, mg-30 wt. % Ce and Mg should be polished in advance in step ①.

Preferably, the gas mixture in step ② is $CO_2$ and $SF_6$ in a volume ratio of 99%:1%.

Preferably, the RJ-6 refining agent in step ④ needs to be dried at 200~250° C. for 30 min before using.

Preferably, the mold described in Step® is a permanent metal mold and needs to be preheated at 200° C. for 30 to 60 min.

Compared with the prior art, the invention has the following beneficial effects:

1. The present invention obtains a high strength Mg—Zn—Al—Mn-RE cast magnesium alloy by compound addition of low cost rare earth elements RE (La and Ce) to further optimize and improve the absolute strength and toughness of the Mg—Zn—Al system magnesium alloy. The compound addition of a small amount of La and Ce in the Mg—Zn—Al alloy has the following advantages:

① Adding rare earth elements can purify the alloy melt and increase the corrosion resistance and casting performance of the alloy;

② RE elements (La and Ce) can combine with Al elements in the alloy to form Al—Re strengthening phases, such as RE3Al11, which can improve the creep resistance of the alloy and inhibit the growth of other second phases, so that the second phase is distributed in fine dispersion state, which plays the role of dispersion strengthening;

③ After the addition of rare earth elements, the precipitation of rare earth phase can effectively inhibit the growth of grain, and there is solute segregation, rare earth elements are enriched at the front of the solid-liquid interface, which can inhibit the growth of grain, and can make the grain refinement. Grain refinement increases the number of grain boundaries, and then increases the resistance of the dislocation of the pre-slipped grains to move to the adjacent grains, resulting in the dislocation locking near the grain boundaries, which can significantly improve the mechanical properties of magnesium alloys.

2. The invention provides a cast magnesium alloy with low cost and high strength. Its tensile strength ranges from 300 MPa-314 MPa, and elongation ranges from 7%-13% at room temperature. In addition, the cast magnesium alloy has low light rare earth content and low raw material and processing cost, so as to realize mass production.

3. In the process of melt purification, the melt is refined by RJ-6 refining agent first, and then standing. The impurities in the melt can be greatly reduced through the purification of the two steps, so as to ensure the mechanical properties and corrosion resistance of the alloy.

4. The heat treatment process adopted by the invention is two-stage solution an +two-stage aging, which can greatly improve the strengthening effect of the alloy. One of the advantages of two-stage solution is that: on the one hand, due to the existence of component segregation, the solute atom content in different regions of the alloy is not the same, the first-stage solution treatment can make the alloy composition uniform, eliminate segregation, so as to prevent the occurrence of overburning caused by the uneven composition. On the other hand, the two-stage solution allows the second phase distributed along the grain boundary to dissolve into the matrix as much as possible to obtain susaturated solid solution ready for aging, while the grain size is not too coarse.

The benefits of two-stage aging are: first-stage aging, also known as low-temperature pre-aging, facilitates the formation of Zn-rich solute atomic polarisation zones. The solute atomic-rich zones occur at the beginning of aging at low temperature, and are formed rapidly and usually uniformly distributed. The crystal structure of the solute atomic-rich region is the same as that of the matrix, and there is a high congruence relationship, which can be used as the heterogeneous nucleation site to increase the nucleation rate and refine the grain. During secondary aging, also known as high temperature aging, the solute atom-rich zone can be used as the heterogeneous nucleation site of the precipitated enhanced phase, so that the precipitated phase located in the solute atom segregation zone can be precipitated in a large amount in a small form, thus obtaining high-density and fine precipitated particles, which can play a role in nelling dislocation and grain boundaries, and greatly improve the alloy strength.

Other advantages, objectives and characteristics of the invention will be partly reflected in the following descriptions and partly understood by the technicians in the field through the study and practice of the invention.

ILLUSTRATIONS

SPECIFIC IMPLEMENTATION METHODS

Figure 1:
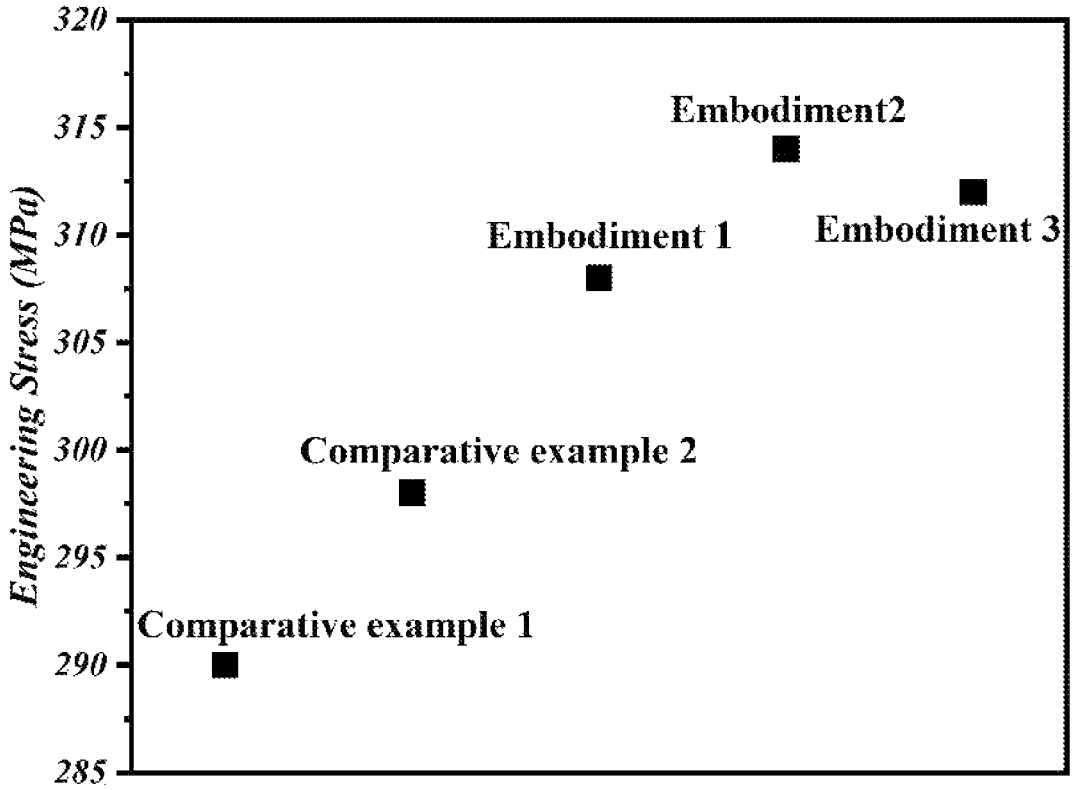
FIG. 1 is a comparison diagram of tensile strength between embodiments of the invention and proportions.

In order to make the technical means, creation features, purpose and function of the invention more clear and easy to understand, the invention is further elaborated in combination with the specific implementation mode:

Embodiment 1

① Batching: preparing Zn 7.0%, Al 3.0%, Mn 0.4%, RE 1.0%, total impurities less than 0.04%, and the balance is Mg, in which RE includes La and Ce, La and Ce account for 35% and 65% of the total RE addition, respectively. La and Ce are added in the form of Mg-30 wt. % La and Mg-30 wt. % Ce intermediate alloys. The oxide film on the surface of the raw material is sanded off and then dried.

② Al, Mg-5 wt. % Mn and Mg are first put into a clean iron crucible of the resistance furnace, the melting temperature is controlled at 740° C., and the volume ratio of 99%:1% $CO_2$ and $SF_6$ are used as protective gases. After all the metals in the crucible were melted, Zn, Mg-30 wt. % La and Mg-30 wt. % Ce were added at last. An initial alloy melt is obtained after 20 minutes of melting.

③ Melt purification: After obtaining preliminary alloy melt, RJ-6 refining agent is used to purify and refine the alloy melt. The amount of refining agent is 1% of the weight of the total charge, and the refining agent needs to be dried at 200° C. for 30 min. During refining, the alloy melt is evenly stirred with a slotted spoon to ensure fully contact between the refining agent and the alloy melt. The stirring time is 5 mins. After refining, the alloy melt was treated by stirring and scraping, and then the temperature was set to 720° C. and kept warm for 30 min before pouring.

④ Casting: The mold is permanent metal mold. In order to improve the fluidity of melt and ensure the filling ability, the mold needs to be preheated at 200° C. for 60 min. After 10 min of pouring, the mold is demoulded and cooled to room temperature in the air to get the final alloy ingot.

⑤ Heat treatment: The alloy obtained in step is treated at 350° C. for 40 h for primary solid solution, 370° C. for 8 h for secondary solid solution, and quenched in water with a water temperature of about 10° C. After the completion of solid solution treatment, pre-aging at 75° C. for 24 h, and finally quenching at 175° C. for 2 h in water with a water temperature of about 10° C. High strength cast magnesium alloy is obtained.

Embodiment 2

① Batching: preparing Zn 7.0%, Al 4.0%, Mn 0.3%, RE 0.8%, total impurities less than 0.04%, and the balance is Mg, in which RE includes La and Ce, La and Ce account for 35% and 65% of the total RE addition, respectively. La and Ce are added in the form of Mg-30 wt. % La and Mg-30 wt. % Ce intermediate alloys. The oxide film on the surface of the raw material is sanded off and then dried.

② Al, Mg-5 wt. % Mn and Mg are first put into a clean iron crucible of the resistance furnace, the melting temperature is controlled at 750° C., and the volume ratio of 99%:1% $CO_2$ and $SF_6$ are used as protective gases; After all the metals in the crucible were melted, Zn, Mg-30 wt. % La and Mg-30 wt. % Ce were added at last. An initial alloy melt is obtained after 18 minutes of melting.

③ Melt purification: After obtaining preliminary alloy melt, RJ-6 refining agent is used to purify and refine the alloy melt. The amount of refining agent is 1.5% of the weight of the total charge, and the refining agent needs to be dried at 230° C. for 30 min. During refining, the alloy melt is evenly stirred with a slotted spoon to ensure full contact between the refining agent and the alloy melt. The stirring time is 4 min. After refining, the alloy melt was treated by stirring and scraping, and then the temperature was set to 730° C. and kept warm for 25 min before pouring.

④ Casting: The mold is permanent metal mold. In order to improve the fluidity of melt and ensure the filling ability, the mold needs to be preheated at 200° C. for 40 min. After 7 min of pouring, the mold is demoulded and cooled to room temperature in the air to get the final alloy ingot.

⑤ Heat treatment: The alloy obtained in step ④ is treated at 350° C. for 40 h for primary solid solution, 370° C. for 8 h for secondary solid solution, and quenched in water with a water temperature of about 15° C. After the completion of solid solution treatment, pre-aging at 75° C. for 24 h, and finally quenching at 175° C. for 2 h in water with a water temperature of about 15° C. High strength cast magnesium alloy is obtained.

Embodiment 3

① Batching: preparing Zn 7.0%, Al 5.0%, Mn 0.5%, RE 0.5%, total impurities less than 0.04%, and the balance is Mg, in which RE includes La and Ce, La and Ce account for 35% and 65% of the total RE addition, respectively. La and Ce are added in the form of Mg-30 wt. % La and Mg-30 wt. % Ce intermediate alloys. The oxide film on the surface of the raw material is sanded off and then dried.

② Al, Mg-5 wt. % Mn and Mg are first put into a clean iron crucible of the resistance furnace, the melting temperature is controlled at 760° C., and the volume ratio of 99%:1% $CO_2$ and $SF_6$ are used as protective gases; After all the metals in the crucible were melted, Zn, Mg-30 wt. % La and Mg-30 wt. % Ce were added at last. An initial alloy melt is obtained after 15 minutes of melting.

③ Melt purification: After obtaining preliminary alloy melt, RJ-6 refining agent is used to purify and refine the alloy melt. The amount of refining agent is 2% of the weight of the total charge, and the refining agent needs to be dried at 250° C. for 30 min. During refining, the alloy melt is evenly stirred with a slotted spoon to ensure full contact between the refining agent and the alloy melt. The stirring time is 3 min. After refining, the alloy melt was treated by stirring and scraping, and then the temperature was set to 740° C. and kept warm for 20 min before pouring.

④ Casting: The mold is permanent metal mold. In order to improve the fluidity of melt and ensure the filling ability, the mold needs to be preheated at 200° C. for 30 min. After 5 min of pouring, the mold is demoulded and cooled to room temperature in the air to get the final alloy ingot.

⑤ Heat treatment: The alloy obtained in step ④ is treated at 350° C. for 40 h for primary solid solution, 370° C. for 8 h for secondary solid solution, and quenched in water with a water temperature of about 20° C. After the completion of solid solution treatment, pre-aging at 75° C. for 24 h, and finally quenching at 175° C. for 2 h in water with a water temperature of about 20° C. High strength cast magnesium alloy is obtained.

Comparative Example 1

① Batching: preparing Zn 7.0%, Al 3.0%, Mn 0.4%, total impurities less than 0.04%, and the balance is Mg. The oxide film on the surface of the raw material is sanded off and then dried.

② Al, Mg-5 wt. % Mn and Mg are first put into a clean iron crucible of the resistance furnace, the melting temperature is controlled at 740° C., and the volume ratio of 99%:1% $CO_2$ and $SF_6$ are used as protective gases; After all the metals in the crucible were melted, Zn was added at last. After 20 min of melting, the initial alloy melt was obtained.

③ Melt purification: After obtaining preliminary alloy melt, RJ-6 refining agent is used to purify and refine the alloy melt. The amount of refining agent is 1% of the weight of the total charge, and the refining agent needs to be dried at 200° C. for 30 min. During refining, the alloy melt is evenly stirred with a slotted spoon to ensure full contact between the refining agent and the alloy melt. The stirring time is 5 min. After refining, the alloy melt was treated by stirring and scraping, and then the temperature was set to 720° C. and kept warm for 30 min before pouring.

④ Casting: The mold is permanent metal mold. In order to improve the fluidity of melt and ensure the filling ability, the mold needs to be preheated at 200° C. for 60 min. After 10 min of pouring, the mold is demoulded and cooled to room temperature in the air to get the final alloy ingot.

⑤ Heat treatment: The alloy obtained in step ④ is treated at 350° C. for 40 h for primary solid solution, 370° C. for 8 h for secondary solid solution, and quenched in water with a water temperature of about 10° C. After the completion of solid solution treatment, pre-aging at 75° C. for 24 h, and finally quenching at 175° C. for 2 h in water with a water temperature of about 10° C. High strength cast magnesium alloy is obtained.

Comparative Example 2

① Batching: preparing Zn 7.0%, Al 5.0%, Mn 0.5%, total impurities less than 0.04%, and the balance is Mg. The oxide film on the surface of the raw material is sanded off and then dried.

② Al, Mg-5 wt. % Mn and Mg are first put into a clean iron crucible of the resistance furnace, the melting temperature is controlled at 760° C., and the volume ratio of 99%:1% $CO_2$ and $SF_6$ are used as protective gases; After all the metals in the crucible were melted, Zn was added at last. After 15 min of melting, the initial alloy melt was obtained.

③ Melt purification: After obtaining preliminary alloy melt, RJ-6 refining agent is used to purify and refine the alloy melt. The amount of refining agent is 2% of the weight of the total charge, and the refining agent needs to be dried at 250° C. for 30 min. During refining, the alloy melt is evenly stirred with a slotted spoon to ensure full contact between the refining agent and the alloy melt. The stirring time is 3 min. After refining, the alloy melt was treated by stirring and scraping, and then the temperature was set to 740° C. and kept warm for 20 min before pouring.

④ Casting: The mold is permanent metal mold. In order to improve the fluidity of melt and ensure the filling ability, the mold needs to be preheated at 200° C. for 30 min. After 5 min of pouring, the mold is demoulded and cooled to room temperature in the air to get the final alloy ingot.

⑤ Heat treatment: The alloy obtained in step ④ is treated at 350° C. for 40 h for primary solid solution, 370° C. for 8 h for secondary solid solution, and quenched in water with a water temperature of about 20° C. After the completion of solid solution treatment, pre-aging at 75° C. for 24 h, and finally quenching at 175° C. for 2 h in water with a water temperature of about 20° C. High strength cast magnesium alloy is obtained.

The tensile strength and elongation of the alloy obtained by each embodiment and ratio are shown in the table 1 below:

| | | | Age-state performance | |
|---|---|---|---|---|
| | Solution treatment | Aging treatment | UTS (MPa) | Elongaiton (%) |
| Embodiment 1 | 350° C./40 h + 370° C./8 h | 75° C./24 h + 175° C./2 h | 308 ± 3 MPa | 10 ± 0.5% |
| Embodiment 2 | 350° C./40 h + 370° C./8 h | 75° C./24 h + 175° C./2 h | 314 ± 3 MPa | 13 ± 0.5% |
| Embodiment 3 | 350° C./40 h + 370° C./8 h | 75° C./24 h + 175° C./2 h | 312 ± 3 MPa | 12 ± 0.5% |
| Comparative example 1 | 350° C./40 h + 370° C./8 h | 75° C./24 h + 175° C./2 h | 290 ± 3 MPa | 9 ± 0.5% |
| Comparative example 2 | 350° C./40 h + 370° C./8 h | 75° C./24 h + 175° C./2 h | 298 ± 3 MPa | 7 ± 0.5% |

It can be seen from FIG. 1 and the above table in Example 1 and Comparative example 1 and Example 3 and Comparative example 2 that the cast grains of magnesium alloy are obviously refined by mixing and adding two light rare earth elements, La and Ce. Moreover, the addition of rare earth elements can combine with Al element in the alloy to form Al—Re strengthening phase, which can improve the creep property of the alloy. The growth of other second phases is inhibited, and the second phase is distributed in fine dispersion state, which plays the role of dispersion strengthening, and finally improves the strength and plasticity of magnesium alloy.

Figure 2:
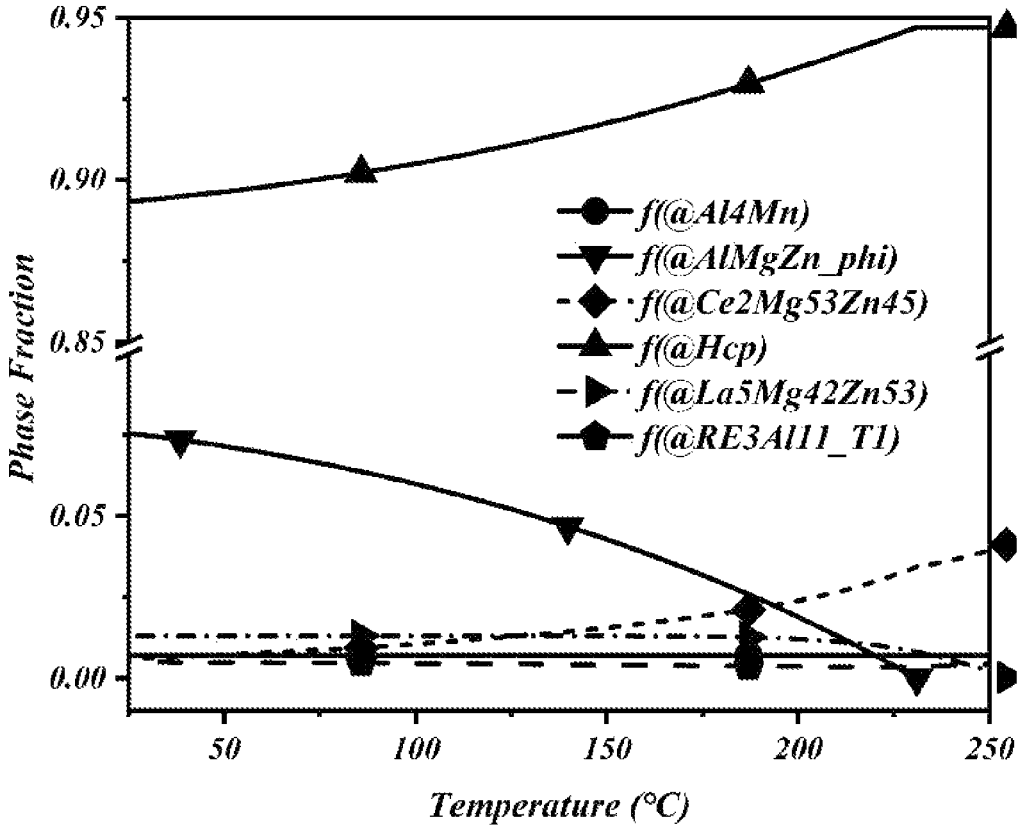
FIG. 2 shows the relationship between phase transition and temperature in embodiment 1 during solidification.
Figure 3:
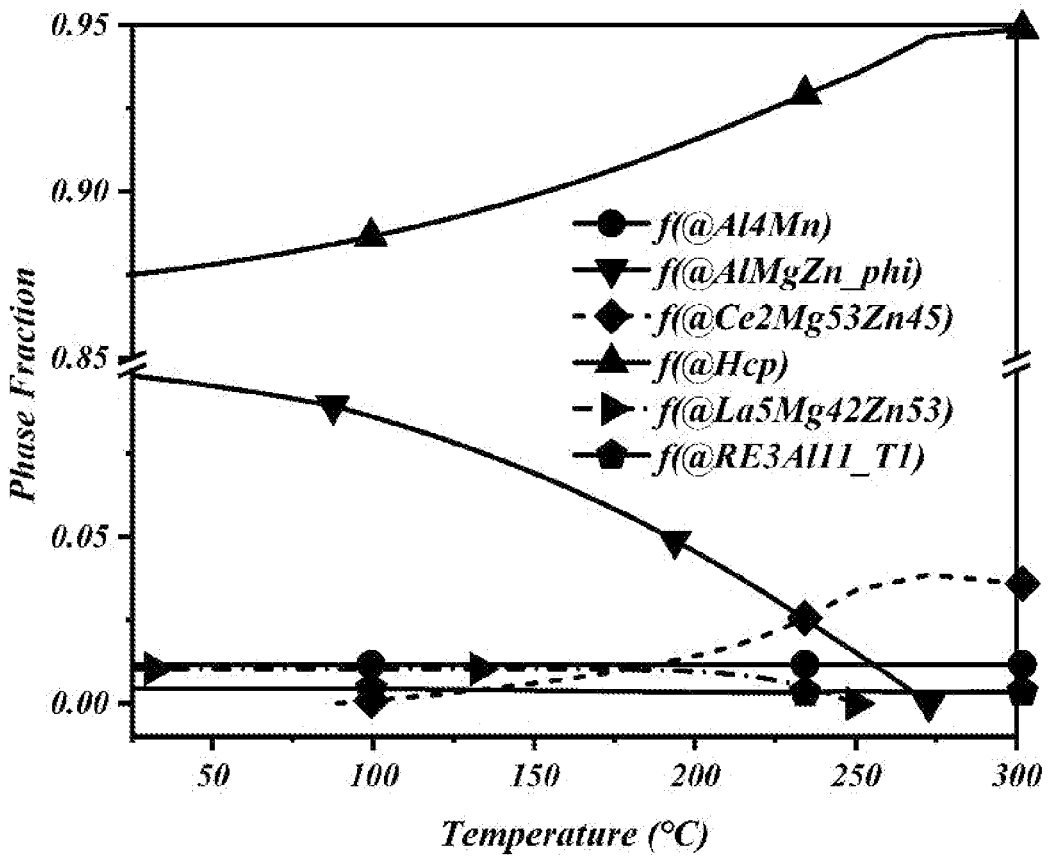
FIG. 3 shows the relationship between phase transition and temperature in embodiment 2 during solidification.
Figure 4:
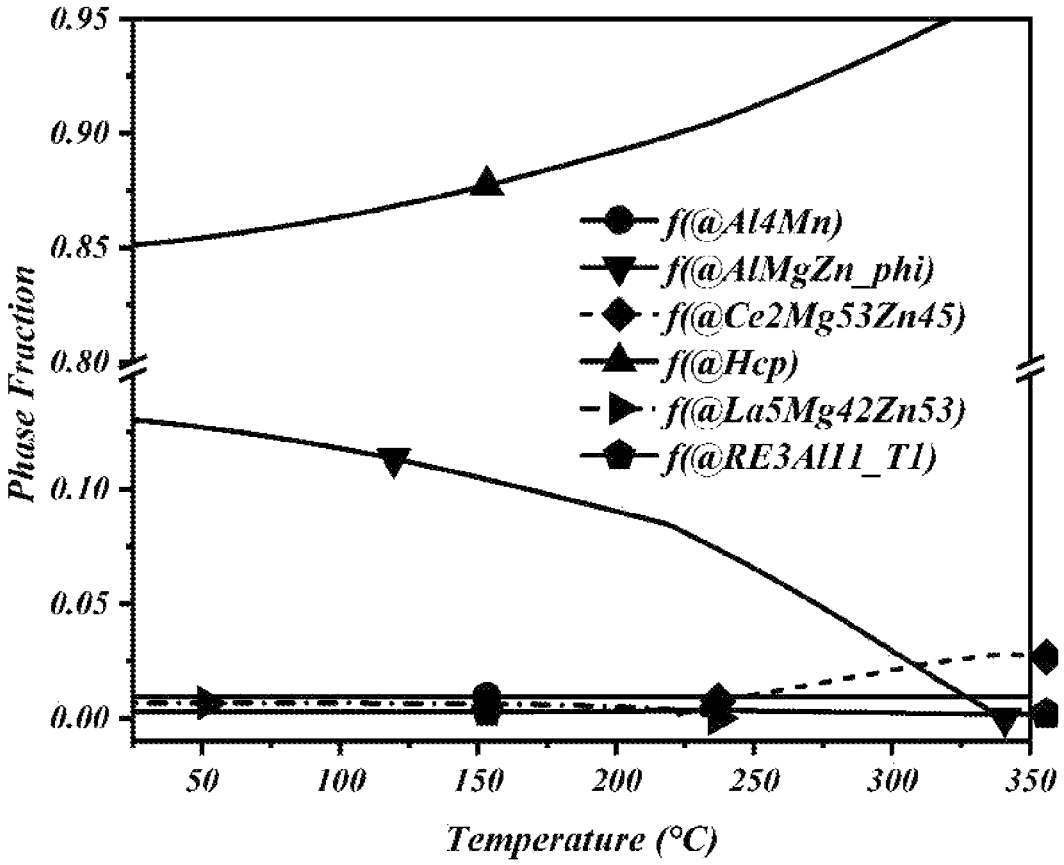
FIG. 4 shows the relationship between phase transition and temperature in embodiment 3 during solidification.

As shown in FIG. 2-4, the relationship between the phase transition and temperature during solidification of the alloy in Embodiment 1-3 is clearly demonstrated. It can be seen from the figure that the formed phases mainly include Hcp, $Al_4Mn$, AlMgZn-phi, $RE_3Al_{11}$, $Ce_2Mg_{53}Zn_{45}$ and $La_5Mg_{42}Zn_{53}$ phases in the late solidification period. It can be found that after adding RE, in addition to Hcp, Al4Mn and AlMgZn-phi phases, intermetallic compound phases containing rare earth elements, such as $RE_3Al11$, are formed in the alloy. According to the analysis, the precipitation of rare earth phase can effectively inhibit the growth of grain, resulting in the effect of fine crystal strengthening.

The fraction of AlMgZn-phi phase increases with the increase of Al content. Moreover, it can be observed from the phase diagram that the second phase containing rare earth is formed before the ternary AlMgZn-phi with larger volume fraction, which is conducive to preventing the growth of the ternary AlMgZn-phi and continuous precipitation, thus refining the ternary AlMgZn-phi, improving the alloy strength and improving the plasticity of the alloy.

Figure 5:
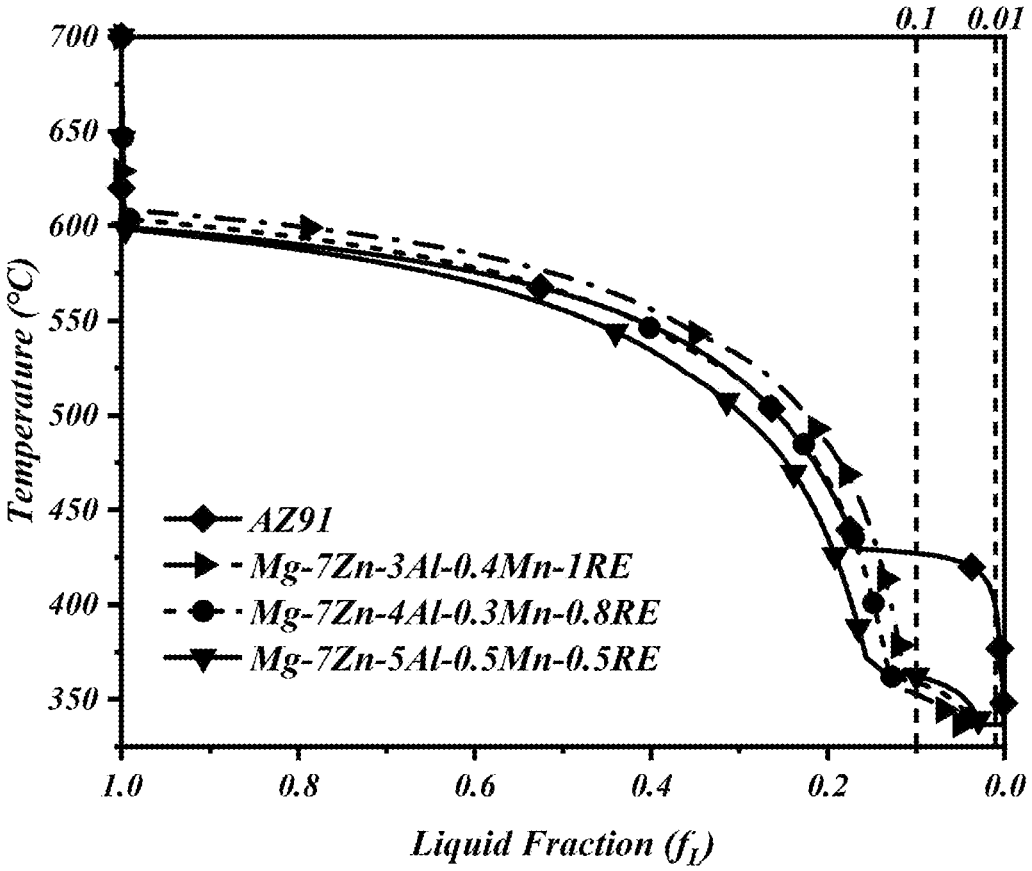
FIG. 5 shows the solidification temperature variation in the fragile region of magnesium alloy in embodiments 1-3.
Figure 6:
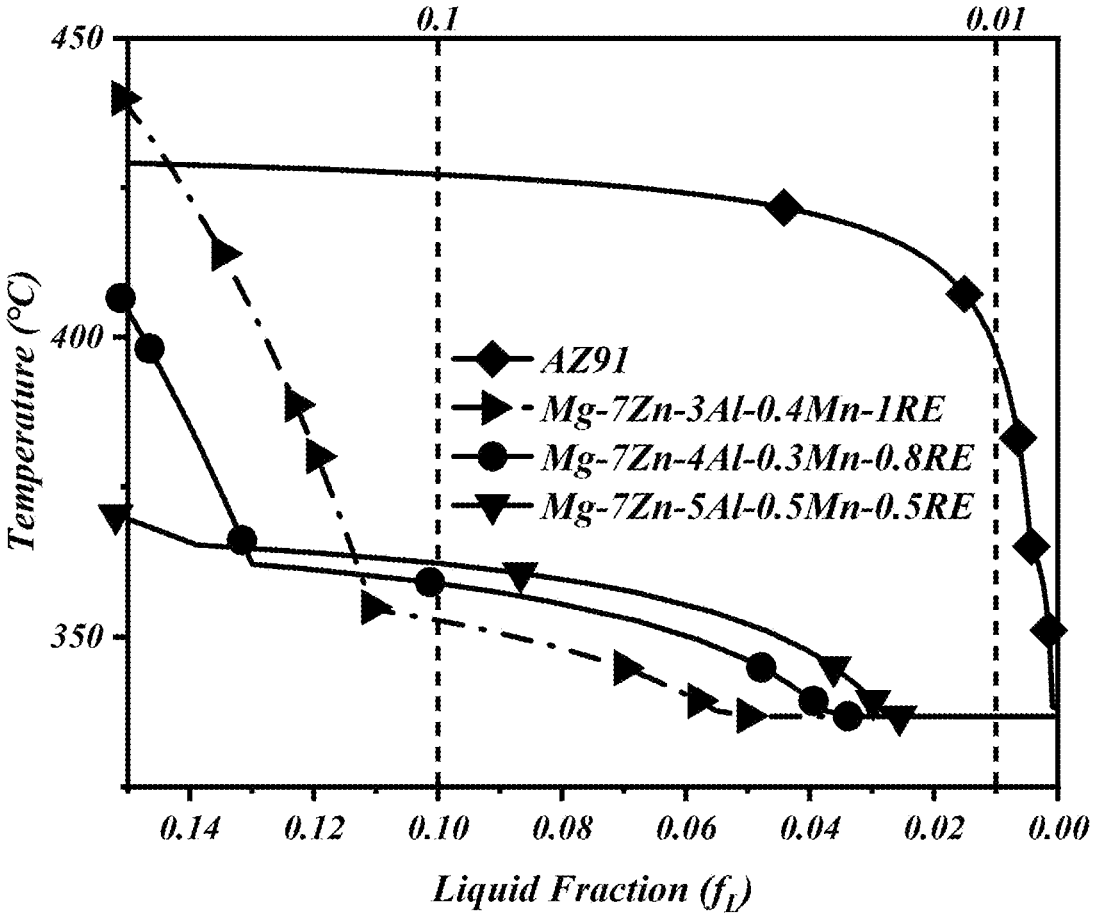
FIG. 6 is a partial enlargement of FIG. 5.

At the same time, the hot cracking tendency of magnesium alloys can be changed by adding rare earth elements La and Ce. As shown in FIGS. 5-6, Pandat software is used to calculate the solidification curve of the alloy of the present invention, and commercial magnesium alloy AZ91 is taken as a reference object. The results are shown in the table 2 below:

| alloys | susceptible freezing range ($f_L$: 0.1-0.01) | Temperature difference of susceptible freezing range (ΔTc/° C.) |
|---|---|---|
| AZ91 | 426.4-396 | 30.4 |
| Embodiment 1 | 351.6-336.7 | 14.9 |
| Embodiment 2 | 357.4-339.3 | 18.1 |
| Embodiment 3 | 362.2-339.4 | 22.8 |

As can be seen from the above table 2, the temperature difference (ΔTc) in the susceptible freezing range of embodiments 1-3 is smaller than AZ91 alloy, so the hot cracking tendency of the magnesium alloy of the present invention is smaller.

In addition to the composition factors of magnesium alloys, solidification conditions are also an important factor affecting the hot cracking tendency of alloys. Solidification conditions include casting temperature, mold temperature, cooling rate and other parameters. In the present invention, the solidification conditions are optimized through literature research and experiment, so as to effectively reduce the hot cracking tendency of magnesium alloy in the casting process.

Finally, the above embodiments are used only to illustrate the technical scheme of the invention and not to restrict it. Although the invention is described in detail with reference to the better embodiments, ordinary technicians in the field should understand that the technical scheme of the invention may be modified or equivalent replaced without deviating from the purpose and scope of the technical scheme of the invention. They shall be covered by the claims of the invention.

What is claimed is:

1. A high strength cast magnesium alloy, wherein the composition and mass percentage of the cast magnesium alloy are: Zn 7.0%, Al 3.0%~5.0%, Mn 0.3%~0.5%, rare earth elements 0.5%~1%, the total amount of inevitable impurities is less than or equal to 0.04%, and the balance is Mg, wherein the rare earth elements consist of La and Ce, which account for 35% and 65% of the total added rare earth elements, respectively, among them, Mn, La and Ce are added in the form of Mg-5 wt. % Mn, Mg-30 wt. % La and Mg-30 wt. % Ce intermediate alloys respectively.

2. A method for preparing the high strength cast magnesium alloy according to claim 1, comprising the steps of:

① Batching: Zn, Al, Mg-5 wt. % Mn, Mg-30 wt. % La, Mg-30 wt. % Ce and Mg are batched according to mass percentage and then dried;

② Smelting: firstly putting the Al, Mg-5 wt. % Mn and Mg into a iron crucible, then melted using a resistance furnace, the melting temperature is controlled between 740° C. and 760° C. and a gas mixture is used as protective gas during melting, after all the metal in the crucible has been melted, Zn, Mg-30 wt. % La and Mg-30 wt. % Ce are finally added thereto, the initial alloy melt is obtained after 15~20 mins of smelting;

③ Melt purification: RJ-6 refining agent is used to refine the alloy melt obtained in step ②, in which the amount of RJ-6 refining agent is 1~2% of the weight of the total furnace charge, during the refining process, it needs to be stirred for 3~5 min, after refining, the alloy melt is stirred and slagged, and then the temperature is adjusted to 720~740° C. and the heat is kept for 20~30 min;

④ Casting: the alloy melt obtained in step ③ is poured into the mould and is demoulded after 5~10 mins of pouring, and is cooled to room temperature in air to obtain the alloy ingots;

⑤ Heat treatment: the alloy ingots obtained in step ④ are subjected to primary solid solution treatment at 350° C. for 40 h; secondary solid solution treatment at 370° C. for 8 h and finally quenched in water at a temperature of 10~20° C.; after the solid solution treatment, the high strength cast magnesium alloy is obtained by preaging at 75° C. for 24 h, then at 175° C. for 2 h, and finally quenching in water at a temperature of 10~20° C.

3. The method of claim 2, wherein Zn, Al, Mg-5 wt. % Mn, Mg-30 wt. % La, Mg-30 wt. % Ce and Mg should be polished in advance in step ①.

4. The method of claim 2, wherein the gas mixture in step ② is $CO_2$ and $SF_6$ in a volume ratio of 99%:1%.

5. The method of claim 2, wherein the RJ-6 refining agent in step ③ needs to be dried at 200~250° C. for 30 mins before using.

6. The method of claim 2, wherein said mould in step ④ is a permanent metal mould and needs to be preheated at 200° C. for 30~60 min.

7. The high strength cast magnesium alloy according to claim 1, wherein the mass percentage of the element Al is 3.0%, the mass percentage of the element Mn is 0.4%, the mass percentage of the rare earth elements is 1%.

8. The high strength cast magnesium alloy according to claim 1, wherein the mass percentage of the element Al is 4.0%, the mass percentage of the element Mn is 0.3%, the mass percentage of the rare earth elements is 0.8%.

9. The high strength cast magnesium alloy according to claim 1, wherein the mass percentage of the element Al is 5.0%, the mass percentage of the element Mn is 0.5%, the mass percentage of the rare earth elements is 0.5%.

* * * * *